US008655232B2

(12) United States Patent
Wu et al.

(10) Patent No.: US 8,655,232 B2
(45) Date of Patent: Feb. 18, 2014

(54) PROCESSING CARTRIDGE OF AN ELECTROPHOTOGRAPHIC IMAGE FORMING SYSTEM

(75) Inventors: Lianjun Wu, Guangdong (CN); Jinlian Liu, Guangdong (CN); Qingfei Peng, Guangdong (CN)

(73) Assignee: Zhuhai Seine Technology Limited, Zhuhai, Guangdong (CN)

( * ) Notice: Subject to any disclaimer, the term of this patent is extended or adjusted under 35 U.S.C. 154(b) by 92 days.

(21) Appl. No.: 13/131,878

(22) PCT Filed: May 14, 2010

(86) PCT No.: PCT/CN2010/072817

§ 371 (c)(1),
(2), (4) Date: May 30, 2011

(87) PCT Pub. No.: WO2010/142189

PCT Pub. Date: Dec. 16, 2010

(65) Prior Publication Data

US 2012/0070190 A1 Mar. 22, 2012

(30) Foreign Application Priority Data

Jun. 12, 2009 (CN) ..... 2009 1 0107986

(51) Int. Cl.
*G03G 15/08* (2006.01)

(52) U.S. Cl.
USPC ..... 399/258; 399/119; 399/259; 399/260; 399/262; 399/263

(58) Field of Classification Search
USPC ..... 399/258, 259, 262
See application file for complete search history.

(56) References Cited

U.S. PATENT DOCUMENTS

| | | | | |
|---|---|---|---|---|
| 6,266,511 | B1 * | 7/2001 | Murakami et al. | 399/358 |
| 7,729,644 | B2 * | 6/2010 | Thornton et al. | 399/262 |
| 8,095,048 | B2 * | 1/2012 | Awano et al. | 399/260 |
| 8,478,171 | B2 * | 7/2013 | Sasaki | 399/262 |
| 2007/0264055 | A1 * | 11/2007 | Thornton et al. | 399/262 |
| 2008/0019730 | A1 * | 1/2008 | Yoon et al. | 399/106 |
| 2009/0285604 | A1 * | 11/2009 | Nakajima | 399/258 |
| 2010/0080600 | A1 * | 4/2010 | Okamoto et al. | 399/71 |
| 2012/0076548 | A1 * | 3/2012 | Ninomiya et al. | 399/262 |
| 2013/0077994 | A1 * | 3/2013 | Takiguchi | 399/123 |
| 2013/0101317 | A1 * | 4/2013 | Shimizu et al. | 399/258 |
| 2013/0170863 | A1 * | 7/2013 | Leemhuis et al. | 399/258 |
| 2013/0170871 | A1 * | 7/2013 | Buchanan et al. | 399/260 |

* cited by examiner

*Primary Examiner* — David Gray
*Assistant Examiner* — Geoffrey Evans
(74) *Attorney, Agent, or Firm* — Jackson IPG PLLC

(57) ABSTRACT

The invention discloses a processing cartridge, which includes a powder tube, a sliding member and a mechanism for holding the sliding member, wherein the powder tube is used for receiving toner and the sliding member is capable of freely sliding in the powder tube. The mechanism for holding the sliding member is driven to close a powder outlet under the non-use state and a powder outlet portion is arranged on the powder tube. The powder outlet is arranged on the powder outlet portion and the sliding member closes the powder outlet under the action of the mechanism for holding the sliding member under the non-use state, and moves under the action of an external force to open the powder outlet under the use state. An internal member provided with an internal powder feeding opening is also arranged inside the powder outlet portion. The internal member and the powder outlet portion form certain space so that the sliding member is capable of sliding in the space formed by the powder outlet portion and the internal member and the internal powder feeding opening of the internal member is butted with the powder outlet.

5 Claims, 3 Drawing Sheets

PROCESSING CARTRIDGE OF AN ELECTROPHOTOGRAPHIC IMAGE FORMING SYSTEM

FIELD OF THE INVENTION

The invention relates to an electrophotographic image forming system (for example, a laser printer, a duplicating machine, a fax machine, etc.), and particularly relates to a processing cartridge of an electrophotographic image forming system.

BACKGROUND OF THE INVENTION

A processing cartridge capable of being dismountable from an electrophotographic image forming system is provided in the prior art, wherein the processing cartridge can supply toner to the electrophotographic image forming system when being installed on the electrophotographic image forming system.

As shown in FIG. 1, a processing cartridge 10 comprises a powder tube 20, a powder outlet portion 30 and a sliding member 40, wherein toner is stored into the powder tube 20; the powder outlet portion 30 is arranged on front end of the powder tube 20; the sliding member 40 is arranged inside the powder outlet portion 30; a powder outlet 301 is arranged on the powder outlet portion 30; and a powder feeding opening 401 is arranged on the sliding member 40.

When the processing cartridge 10 is installed on an electrophotographic image forming system 50, a protrusion 60 of the electrophotographic image forming system 50 drives the sliding member 40 to slide to a preset position; and at this time, the powder feeding opening 401 of the sliding member 40, the powder outlet 301 of the powder outlet portion 30 and an powder inlet 501 of the electrophotographic image forming system 50 are face to face, and the toner in the powder tube 20 can be conveyed to the powder inlet 501 from the powder feeding opening 401 and the powder outlet 301 and is then supplied to the electrophotographic image forming system 50.

When the processing cartridge 10 is dismounted from the electrophotographic image forming system 50, the sliding member 40 is restored to the initial state, namely the state before the processing cartridge 10 is installed on the electrophotographic image forming system 50; and the powder feeding opening 401 does not face the powder outlet 301 at this time so that the toner cannot be conveyed to the powder outlet 301 from the powder feeding opening 401.

However, due to the fact that no sealing member is arranged between the sliding member 40 and the powder outlet portion 30 and due to the shape of the sliding member 40 and other factors such as processing, manufacturing, etc., a gap always exists between the sliding member 40 and the powder outlet portion 30. Therefore, the sliding member cannot completely seal up the powder outlet portion 30 and the toner can still leak out from the gap between the powder outlet portion 30 and the sliding member 40 and then contaminates the electrophotographic image forming system 50.

SUMMARY OF THE INVENTION

The invention provides a processing cartridge to solve the technical problem that toner tends to leak out from a sliding member due to a gap between the sliding member and a powder outlet portion of the prior processing cartridge.

In order to solve the said technical problem, the invention adopts the technical proposal that:

The invention relates to a processing cartridge, which comprises a powder tube used for receiving toner, a sliding member capable of sliding freely in the powder tube and a mechanism for holding the sliding member, wherein a powder outlet portion is arranged on the powder tube; a powder outlet is arranged on the powder outlet portion; and the sliding member closes the powder outlet under the action of the mechanism for holding the sliding member under the non-use state and moves under the action of an external force to open the powder outlet under the use state. The processing cartridge is characterized in that: an internal member provided with an internal powder feeding opening is also arranged inside the powder outlet portion; the internal member and the powder outlet portion form certain space; the sliding member can slide in the space formed by the powder outlet portion and the internal member; and the internal powder feeding opening for the internal member is butted with the powder outlet.

The inside diameter of the sliding member is roughly the same with the outside diameter of the internal member, and the outside diameter of the sliding member is roughly the same with the inside diameter of the powder outlet portion. A sealing member is arranged on the outer circumference of the internal member, and a sealing member is arranged between the internal member and the powder outlet portion to prevent the leakage of the toner.

The mechanism for holding the sliding member consists of a first magnetic member which is arranged on the powder tube and a second magnetic member which is arranged on the sliding member and generates a mutual magnetic force with the first magnetic member.

The sliding member is a hollow cylinder provided with an intermediate powder feeding opening, wherein under the non-use state, the sliding member drives the intermediate powder feeding opening, the powder outlet for the powder tube and the internal powder feeding opening for the internal member to be distributed in a staggered way under the action of the magnetic force of the first magnetic member and the second magnetic member, and a powder outlet channel is closed; and under the use state, the sliding member moves under the action of an external force to drive the intermediate powder feeding opening to be butted with the powder outlet for the powder tube and the internal powder feeding opening for the internal member, and the powder outlet channel is opened.

The sliding member is a cylinder block, wherein under the non-use state, the sliding member completely keeps out the powder outlet for the powder tube under the action of the magnetic force of the first magnetic member and the second magnetic member, and the powder outlet channel is closed; and under the use state, the sliding member moves under the action of the external force so that the sliding member cannot completely keep out the powder outlet for the powder tube, and the powder outlet channel is opened.

By adoption of the technical proposal, the internal member provided with the internal powder feeding opening is also arranged inside the powder outlet portion, so a toner sealing mechanism is added equivalently. Therefore, the toner cannot be leaked out due to the fact of resealing by the adding of the internal member even though a gap exists between the sliding member and the powder outlet portion. The processing cartridge solves the technical problem that toner tends to be leaked out from a sliding member due to a gap between the sliding member and a powder outlet portion of the prior processing cartridge.

DETAILED DESCRIPTION OF THE PREFERRED EMBODIMENTS

Figure 1:
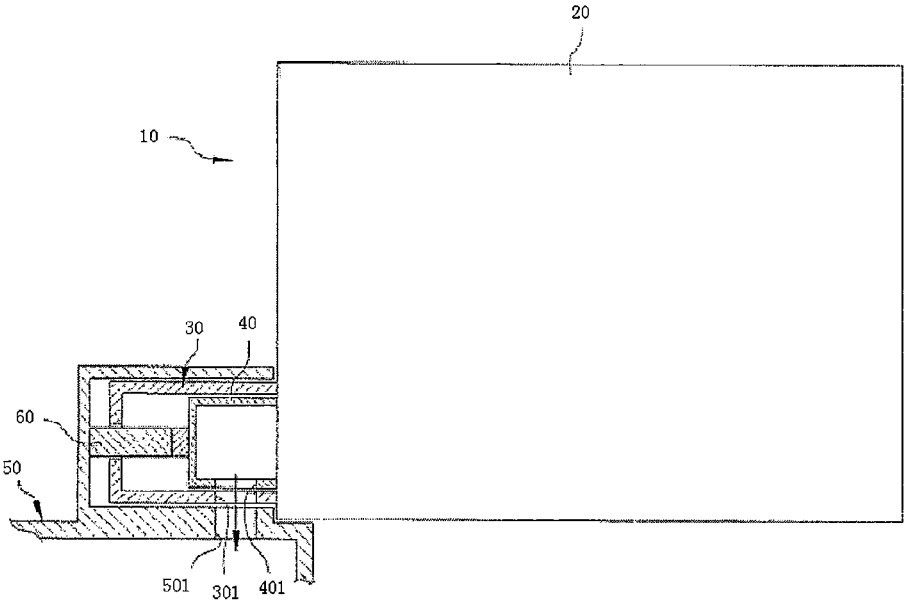
FIG. 1 (Prior Art)
FIG. 1 is a structure diagram of a processing cartridge in the prior art.
Figure 2:
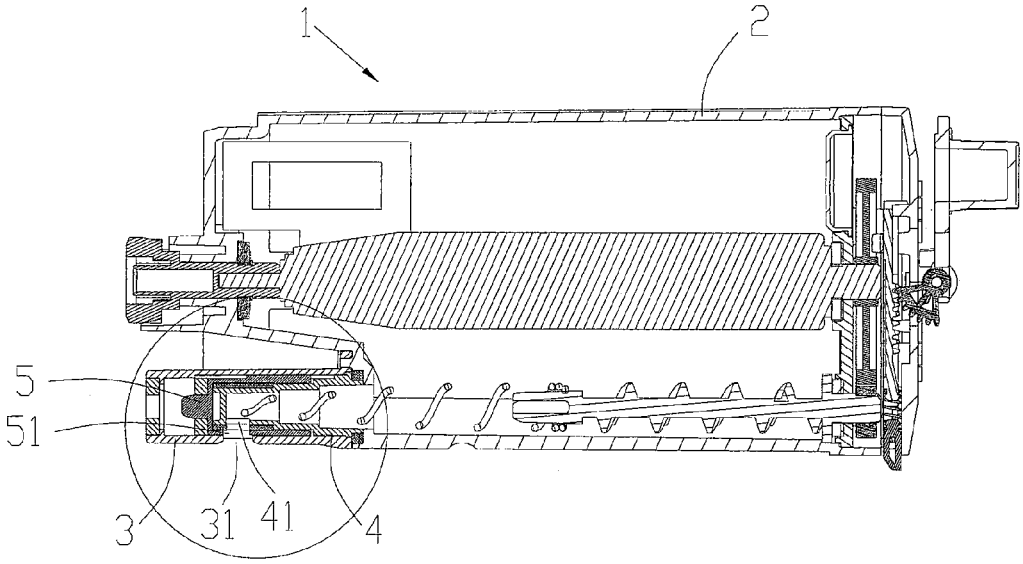
FIG. 2 is a sectional view of a processing cartridge embodiment.

As shown in FIG. 2, a processing cartridge 1 comprises a powder tube 2, a powder outlet portion 3, an internal member 4 and a sliding member 5, wherein the powder tube 2 takes the shape of a cylinder; and toner is stored into the powder tube 2 and can be conveyed to the powder outlet portion 3.

The powder outlet portion 3 is arranged on a front end of the powder tube 2, matched with a corresponding member of an electrophotographic image forming system, and supplies the toner to the electrophotographic image forming system; and a powder outlet 31 is arranged on the powder outlet portion 3.

The internal member 4 is arranged and fixed inside the powder outlet portion 3 and forms certain space with the powder outlet portion 3; and an internal powder feeding opening 41 is arranged on the internal member 4.

Figure 5:
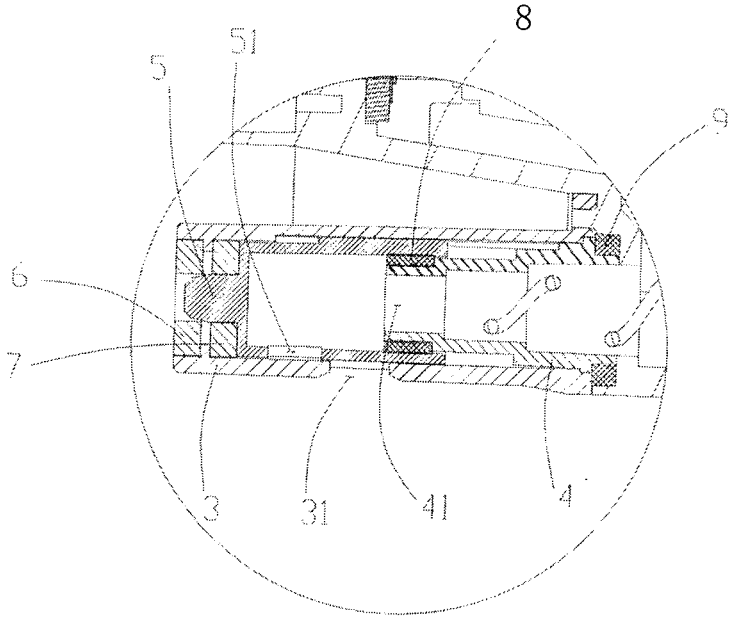
FIG. 5 is a partially enlarged view of a powder outlet portion for another processing cartridge embodiment before the processing cartridge is installed on an electrophotographic image forming system.

The internal powder feeding opening 41 can be arranged on the circumferential surface of the internal member 4 as shown in FIG. 2 and can also be arranged at one end of the internal member 4 as shown in FIG. 5.

The sliding member 5 is arranged on the space formed by the powder outlet portion 3 and the internal member 4 and can slide in the space; and an intermediate powder feeding opening 51 is arranged on the sliding member 5.

Figure 3:
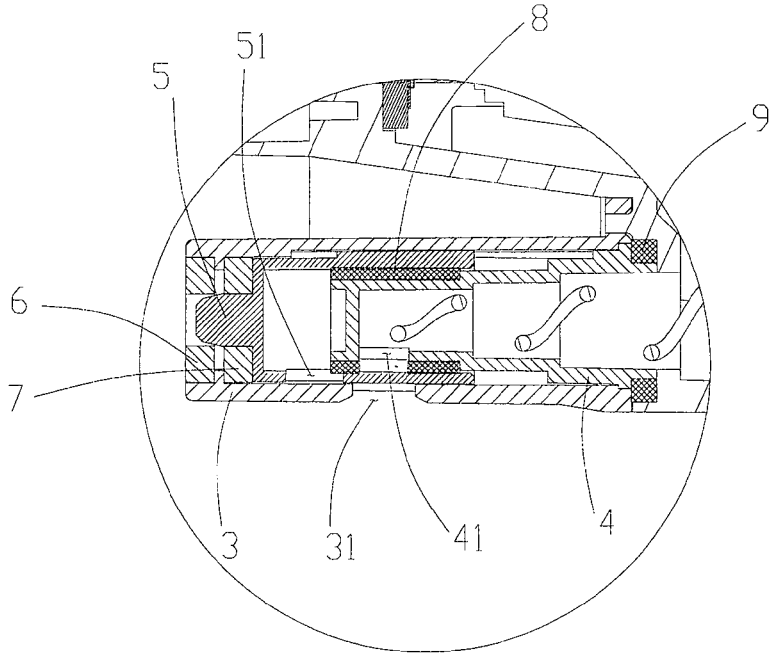
FIG. 3 is a partially enlarged view of a powder outlet portion of said processing cartridge embodiment before the processing cartridge is installed on an electrophotographic image forming system.
Figure 4:
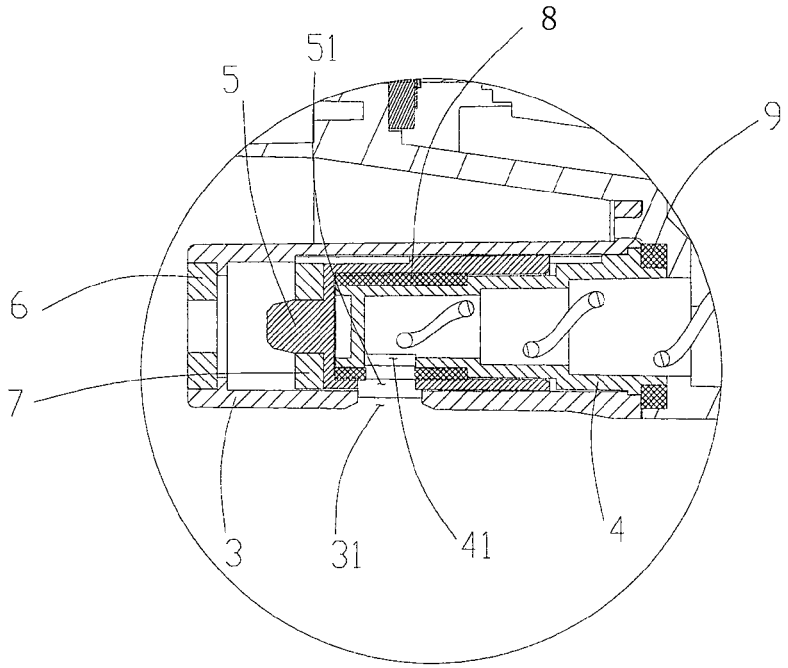
FIG. 4 is a partially enlarged view of a powder outlet portion of said processing cartridge embodiment after the processing cartridge is installed on an electrophotographic image forming system.

As shown in FIGS. 3 and 4, a first magnetic member 6 is arranged on front end of the powder outlet portion 3; a second magnetic member 7 is arranged on front end of the sliding member 5 corresponding to the first magnetic member 6; and a sealing member 8 and a sealing member 9 are respectively arranged on the outer circumference and right end of the internal member 4 to prevent the leakage of the toner.

FIG. 3 is a state diagram of the processing cartridge 1 before the processing cartridge 1 is installed on the electrophotographic image forming system. At this time, the sliding member 5 is at a left end of the powder outlet portion 3; the sliding member 5 is on the initial state; and the intermediate powder feeding opening 51 is not butted with the internal powder feeding opening 41 and the powder outlet 31, so the toner cannot flow out from the processing cartridge 1. Moreover, the sealing member 8 is arranged between the internal member 4 and the sliding member 5 to prevent the toner to leak out from the gap between the internal member 4 and the sliding member 5; and the sealing member 9 is arranged on right end part of the internal member 4 to seal end part of the internal member 4 and prevent the leakage of the toner.

FIG. 4 is a state diagram of the processing cartridge 1 after the processing cartridge 1 is installed on the electrophotographic image forming system. At this time, the sliding member 5 is pushed to a right end of the powder outlet portion 3 and the intermediate powder feeding opening 51 faces the internal powder feeding opening 41 and the powder outlet 31, so the toner in the powder tube 2 can flow out of the powder outlet 31 from the internal powder feeding opening 41 and the intermediate powder feeding opening 51.

After the processing cartridge 1 is dismounted from the electrophotographic image forming system, the sliding member 5 is restored to the initial state, as shown in FIG. 3, under the action of a magnetic force of the first magnetic member 6 and the second magnetic member 7. At this time, the powder outlet 31 and the internal powder feeding opening 41 are resealed so that the toner cannot flow out.

Naturally, a cylinder block can be directly adopted as the sliding member while the internal powder feeding opening 51 is not arranged. Under the non-use state, the sliding member completely keeps out the powder outlet under the action of the magnetic force of the first magnetic member and the second magnetic member, and the powder outlet channel is closed; and under the use state, the sliding member moves under the action of the external force so that the sliding member cannot completely keep out the powder outlet for the powder tube, and the powder outlet channel is opened.

What is claimed is:

1. A processing cartridge, comprising a powder tube used for storing toner, a sliding member capable of sliding freely in the powder tube and a mechanism for holding the sliding member, a powder outlet portion arranged on the powder tube, a powder outlet arranged on the powder outlet portion, the sliding member closing the powder outlet under the action of the mechanism under the non-use state and opening the powder outlet under the action of an external force under the use state, wherein, an internal member provided with an internal powder feeding opening is arranged inside the powder outlet portion, wherein the mechanism for holding the sliding member consists of a first magnetic member which is arranged on the powder tube and a second magnetic member which is arranged on the sliding member and generates a mutual magnetic force with the first magnetic member, wherein the sliding member is a hollow cylinder provided with an intermediate powder feeding opening;

under the non-use state, the sliding member causes the intermediate powder feeding opening, the powder outlet of the powder tube, and the internal powder feeding opening of the internal member to be distributed in a staggered way under the action of the magnetic force of the first magnetic member and the second magnetic member, and a powder outlet channel is closed; and under the use state, the sliding member moves under the action of the external force to cause the intermediate powder feeding opening to be butted with the powder outlet of the powder tube and the internal powder feeding opening of the internal member, and the powder outlet channel is opened, the internal member and the powder outlet portion form a certain space, the sliding member is capable of sliding in the space formed by the powder outlet portion and the internal member; and the internal powder feeding opening of the internal member is butted with the powder outlet.

2. The processing cartridge according to claim 1, wherein the inside diameter of the sliding member is roughly the same with the outside diameter of the internal member, and the outside diameter of the sliding member is roughly the same with the inside diameter of the powder outlet portion.

3. The processing cartridge according to claim 1, wherein a sealing member is arranged on the outer circumference of the internal member.

4. The processing cartridge according to claim 1, wherein a sealing member is arranged between the internal member and the powder outlet portion.

5. A processing cartridge, comprising a powder tube used for storing toner, a sliding member capable of sliding freely in the powder tube and a mechanism for holding the sliding member, a powder outlet portion arranged on the powder tube, a powder outlet arranged on the powder outlet portion, the sliding member closing the powder outlet under the action of the mechanism under the non-use state and opening the powder outlet under the action of an external force under the use state, wherein the mechanism for holding the sliding member consists of a first magnetic member which is arranged on the powder tube and a second magnetic member which is arranged on the sliding member and generates a mutual magnetic force with the first magnetic member, wherein the sliding member is a cylinder block;

under the non-use state, the sliding member completely keeps out the powder outlet of the powder tube under the action of the magnetic force of the first magnetic member and the second magnetic member, and a powder outlet channel is closed;

and under the use state, the sliding member moves under the action of the external force so that the sliding member cannot completely keep out the powder outlet of the powder tube, and the powder outlet channel is opened, wherein, an internal member provided with an internal powder feeding opening is arranged inside the powder outlet portion, the internal member and the powder outlet portion form a certain space, the sliding member is capable of sliding in the space formed by the powder outlet portion and the internal member; and the internal powder feeding opening of the internal member is butted with the powder outlet.

* * * * *